US006454188B1

(12) United States Patent
Maier

(10) Patent No.: US 6,454,188 B1
(45) Date of Patent: Sep. 24, 2002

(54) FUEL INJECTION VALVE

(75) Inventor: Dieter Maier, Isle of Palms (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,347

(22) PCT Filed: Feb. 22, 2000

(86) PCT No.: PCT/DE00/00494

§ 371 (c)(1),
(2), (4) Date: Apr. 26, 2001

(87) PCT Pub. No.: WO00/79122

PCT Pub. Date: Dec. 28, 2000

(30) Foreign Application Priority Data

Jun. 18, 1999 (DE) ..... 199 27 898

(51) Int. Cl.[7] ..... F02M 61/00

(52) U.S. Cl. ..... 239/533.12; 239/533.2; 239/533.9; 239/533.11; 239/585.1; 239/584; 29/890.124

(58) Field of Search ..... 239/585.1, 585.2, 239/585.3, 585.4, 584, 533.2, 533.3, 533.4, 533.5, 533.6, 533.7, 533.8, 533.9, 533.11, 533.12, 533.14; 29/890.124; 156/92, 293, 294

(56) References Cited

U.S. PATENT DOCUMENTS 4,134,572 A * 1/1979 Schmidt
4,711,400 A 12/1987 Radaelli et al.
4,741,352 A * 5/1988 Gray
4,783,009 A * 11/1988 Coates
4,790,055 A * 12/1988 Raufeisen et al.
4,830,558 A * 5/1989 Sweeney
4,946,107 A 8/1990 Hunt
5,193,747 A 3/1993 Preussner
5,649,358 A * 7/1997 Adachi et al. ..... 29/890.124
6,244,526 B1 * 6/2001 Schuldt et al. ..... 239/585.1

FOREIGN PATENT DOCUMENTS

| | | | |
|---|---|---|---|
| DE | 41 25 155 | | 2/1993 |
| DE | 44 08 875 | | 9/1995 |
| DE | 197 27 414 | | 1/1999 |
| WO | WO-97/22798 | * | 6/1997 |

* cited by examiner

*Primary Examiner*—Robin O. Evans
(74) *Attorney, Agent, or Firm*—Kenyon & Kenyon

(57) ABSTRACT

A fuel injection valve has a valve seat element having a fixed valve seat. A valve closure element coacts with the valve seat to open and close the valve. The valve seat element possesses an outer enveloping surface that is equipped with a coating made of a material other than the material of the valve seat element, or with an adhesive, by way of which a hydraulically sealed join can be achieved between the valve seat element and a valve seat support that receives the valve seat element. The fuel injection valve is suitable in particular for use in fuel injection systems of mixture-compressing spark-ignited internal combustion engines.

11 Claims, 2 Drawing Sheets

FUEL INJECTION VALVE

FIELD OF THE INVENTION

The present invention relates to a fuel injection valve.

BACKGROUND INFORMATION

German Published Patent Application No. 44 08 875 (see FIG. 1) describe a fuel injection valve which has a spherical valve closure element that coacts with a flat valve seating surface of a valve seat element. A perforated spray disk is immovably joined to the valve seat element, on its downstream end face, by way of a weld seam. This valve seat part, comprising the perforated spray disk and valve seat element, is sealedly mounted in a valve seat support. The immovable join between the valve seat part and the valve seat support is accomplished at a retaining rim of the perforated spray disk, which is under radial stress, with a circumferential weld seam.

German Patent No. 41 25 155, is a fuel injection valve in which at least one spray orifice is already provided in the valve seat element. The cylindrical valve seat element is therefore immovably joined to the valve seat support not by way of a perforated spray disk, but rather directly at its outer circumference by way of a circumferential weld seam.

U.S. Pat. No. 4,946,107 has already disclosed an electromagnetically actuable fuel injection valve that has, inter alia, a nonmagnetic thin-walled sleeve as joining element between a core and a valve seat element. The sleeve is immovably joined at its two axial ends to the core and to the valve seat element, so that the sleeve acts as valve seat support for the valve seat element. The core and the valve seat element are configured with an outside diameter such that they protrude into the sleeve at the two ends, so that the sleeve completely surrounds the two components (core and valve seat element) in these inwardly protruding regions. The immovable joins of the sleeve to the core and to the valve seat element are achieved, for example, by press-fitting. There exists, in this context, the risk that the join region will not remain completely hydraulically sealed after press-fitting or over the operating life of the injection valve.

SUMMARY OF THE INVENTION

The fuel injection valves according to the present invention have the advantage of a simple and economical manner of achieving complete hydraulic sealing between a valve seat element and a valve seat support that receives the valve seat element.

It is particularly advantageous in this context that it is possible to dispense with any joining method which requires the application of heat, such as laser welding, which disadvantageously can degrade the highly accurate dimensional tolerances in the sealing region.

Since the coating is applied on the outer enveloping surface of the easy-to-handle valve seat element, production of the coating is an easy and dependable process. The quality of the coatings that are to be applied can moreover be easily monitored.

DETAILED DESCRIPTION

Figure 1:
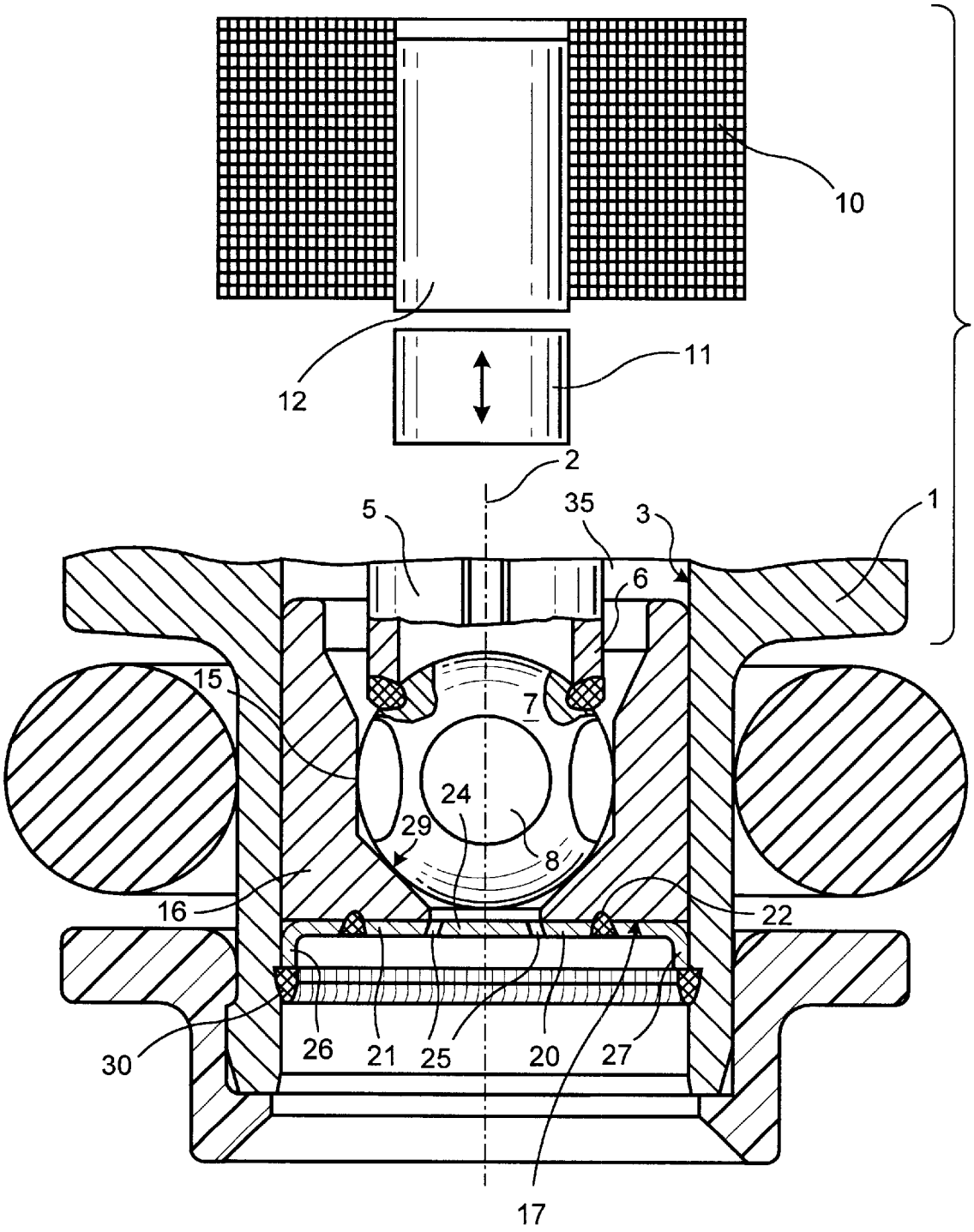
F I G. 1 PRIOR ART
FIG. 1 depicts a portion of a known fuel injection valve.

FIG. 1 shows a portion of a previously known valve, in the form of an injection valve for fuel injection systems of mixture-compressing spark-ignited internal combustion engines.

The injection valve has a tubular valve seat support 1 in which a longitudinal opening 3 is configured concentrically with a longitudinal valve axis 2. Arranged in longitudinal opening 3 is a, for example, tubular valve needle 5 that is joined at its downstream end 6 to a spherical valve closure element 7 on whose circumference are provided, for example, five flattened areas 8.

Actuation of the injection valve is accomplished in known fashion, for example electromagnetically. Piezoelectric or magnetostrictive actuators are also, however, conceivable as excitation elements. A sketched electromagnetic circuit, having a magnet coil 10, an armature 11, and a core 12, serves to move valve needle 5 axially and thus to open the injection valve against the spring force of a return spring (not depicted) and to close it. Armature 11 is joined to the end of valve needle 5 facing away from valve closure element 7 by, for example, a weld seam by way of a laser, and is aligned with core 12. Magnet coil 10 surrounds core 12, which represents the end, surrounded by magnet coil 10, of an inlet fitting (not shown in further detail) which serves to deliver the fuel that is to be metered by the valve.

Guidance of valve closure element 7 during axial movement is provided by a guide opening 15 of a valve seat element 16. The cylindrical valve seat element 16 is sealedly mounted, by welding, into the downstream end of valve seat support 1 that faces away from core 11, in longitudinal opening 3 that extends concentrically with longitudinal valve axis 2. The periphery of valve seat element 16 has a slightly smaller diameter than longitudinal opening 3 of valve seat support 1. At its lower end face 17 facing away from valve closure element 7, valve seat element 16 is joined concentrically and immovably to a bottom part 20 of a perforated spray disk 21 of, for example, cup-shaped configuration.

Valve seat element 16 and perforated spray disk 21 are joined by way of a circumferential and sealed weld seam 22 configured, for example, by way of a laser. This type of installation eliminates the risk of any unwanted deformation of bottom part 20 in its central region 24, in which are located at least one, for example four, spray discharge openings 25 shaped by electrodischarge machining or punching.

Adjoining bottom part 20 of the cup-shaped perforated spray disk 21 is a circumferential retaining rim 26 that extends in an axial direction away from valve seat element 16, and is conically bent outward as far as its end 27. Retaining rim 26 exerts a radial spring effect on the wall of longitudinal opening 3. This prevents any chip formation on the valve seat part and on longitudinal opening 3 as the valve seat part, comprising valve seat element 16 and perforated spray disk 21, is inserted into longitudinal opening 3 of valve seat support 1. At its end 27, retaining rim 26 of perforated spray disk 21 is joined to the wall of longitudinal opening 3 by way of a circumferential and sealed second weld seam 30 configured, for example, by way of a laser.

The insertion depth into longitudinal opening 3 of the valve seat part, comprising valve seat element 16 and the cup-shaped perforated spray disk 21, determines the magnitude of the linear stroke of valve needle 5, since the one end position of valve needle 5, when magnet coil 10 is not energized, is defined by contact of valve closure element 7 against a valve seating surface 29 of valve seat element 16. The other end position of valve needle 5, when magnet coil 10 is energized, is defined, for example, by contact of armature 11 against core 12. The distance between these two end positions of valve needle 5 thus constitutes the linear stroke.

The spherical valve closure element 7 coacts with valve seat surface 29 of valve seat element 16, which surface tapers in truncated conical fashion in the flow direction and is configured in the axial direction between guide opening 15 and lower end face 17 of valve seat element 16.

To ensure that the flow of medium coming from a valve interior 35 also reaches spray discharge openings 25 of perforated spray disk 21, five flattened areas 8 are present on the circumference of the spherical valve closure element 7. For exact guidance of valve closure element 7 and thus of valve needle 5 during axial movement, the diameter of guide opening 15 is configured such that outside its flattened areas 8, the spherical valve closure element 7 projects a small radial distance beyond guide opening 15.

Figure 2:
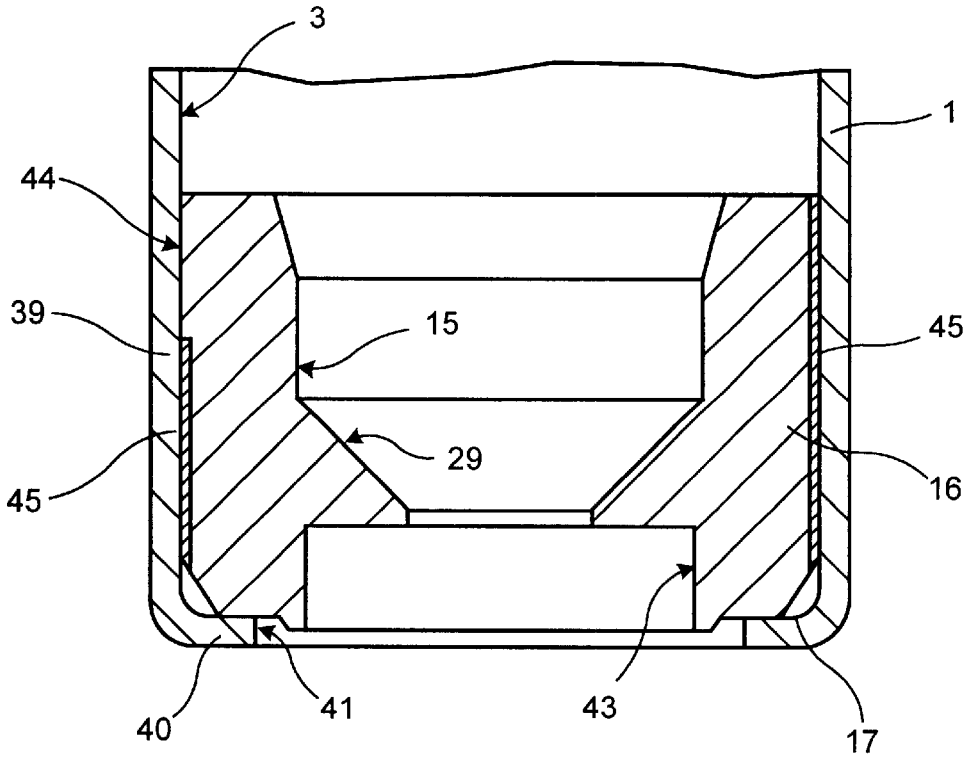
FIG. 2 shows two exemplary embodiments of a valve seat element to be mounted in a valve seat support.
Figure 3:
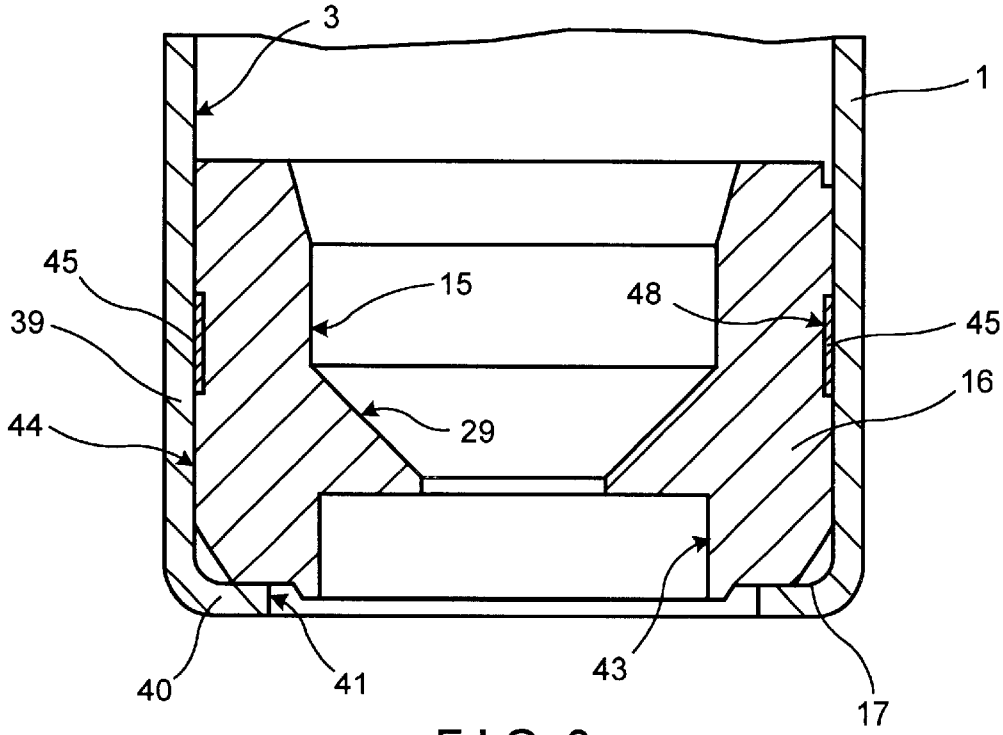
FIG. 3 shows a further exemplary embodiment of a valve seat element to be mounted in a valve seat support.

FIGS. 2 and 3 depict several exemplary embodiments of valve seat elements 16 to be mounted in a valve seat support 1. Valve seat support 1 and valve seat element 16 shown in FIGS. 2 and 3 are embodied in slightly different fashion compared to the components depicted in FIG. 1, in order to illustrate various embodiments. Valve seat support 1 as shown in FIGS. 2 and 3 is configured in sleeve-like fashion with longitudinal opening 3. A thin-walled valve seat support 1 of this kind can, for example, be at least partially surrounded by an injection-molded plastic sheath (not depicted). Valve seat support 1 has been configured, for example, by deep-drawing, a nonmagnetic material, e.g. a stainless CrNi steel, being used. A further difference from valve seat support 1 depicted in FIG. 1 is the fact that valve seat support 1 of FIGS. 2 and 3 comprises an enveloping portion 39 and a bottom portion 40, bottom portion 40 forming the downstream end of valve seat support 1. Longitudinal opening 3 of valve seat support 1 continues in bottom portion 40 as outlet opening 41.

Valve seat element 16 shown in FIGS. 2 and 3 is characterized in that it possesses, downstream from valve seating surface 29, a recess 43 into which, for example, a perforated spray disk 21 can be inserted. Perforated spray disks 21 made of sheet metal or silicon or having a metallic multilayer structure produced by electroplating can be used, inter alia, in this context. At its lower end face 17, valve seat element 16 lies against bottom portion 40 of valve seat support 1 in a rim region surrounding outlet opening 41.

It has hitherto been known to apply a weld seam in order to achieve hydraulic sealing between valve seat element 16 and valve seat support 1. According to the present invention, assembly of these two components 1, 16 is simplified by the fact that an enveloping surface 44 of the cylindrical valve seat element 16 is entirely or partly coated, so that a weld seam can be dispensed with.

Valve seat element 16 is usually manufactured from a chromium steel. According to the present invention, a thin coating 45 is applied onto enveloping surface 44 of valve seat element 16 before it is mounted in valve seat support 1. Coating 45 is applied in controlled fashion at a thickness such that a press-fit join is produced in the pairing between valve seat element 16 and valve seat support 1. As valve seat element 16 is press-fitted into valve seat support 1, the relatively soft coating material deforms plastically in the joining region between the two components, and thereby ensures a secure, hydraulically sealed join without additional joining actions such as the application of a weld seam. Suitable coating materials are, for example, metals such as copper, tin, or nickel; or plastics such as PTFE, known by the trade name Teflon®. Coating is accomplished either by galvanic deposition, by spray technology, or by surface vulcanization.

Since coating 45 is applied on the outer enveloping surface 44 of the easily handled valve seat element 16, the production of coating 45 is a simple and reliable process. It is furthermore easy to monitor the quality of coatings 45 that are being applied.

FIG. 2 schematically indicates two exemplary embodiments of coatings 45; the coating thickness is not shown to scale. The left side illustrates the fact that coating 45 can be performed only in an axial partial region of enveloping surface 44; the right side, in contrast, shows a coating 45 that exists over the entire axial extension of enveloping surface 44 of valve seat element 16. FIG. 3 illustrates an exemplary embodiment in which a circumferential groove 48, which is present in slightly recessed fashion with respect to the remainder of enveloping surface 44, is provided on enveloping surface 44. This groove 48 can be configured with a coating 45 made of metal or plastic. Ultimately this is once again a partially coated enveloping surface 44.

In addition to the aforementioned possibilities, coating 45 can also be achieved by applying an adhesive. Ideally, a fuel-resistant, microencapsulated adhesive is used for this. An adhesive of this kind can be, for example, a liquid capillary-gap adhesive. When the coated valve seat element 16 is press-fitted into valve seat support 1, the encapsulation of the adhesive is ruptures and the adhesive that is released can cure in the join region. This results in an immovable and hydraulically sealed join between valve seat element 16 and valve seat support 1. A subsequent hydraulic sealing weld 30 and/or immobilization for axial retention is no longer necessary. The adhesive is applied, for example, only in an axial partial region of enveloping surface 44 of valve seat element 16, as already indicated, for example, on the left side of FIG. 2 for coating 45.

What is claimed is:

1. A fuel injection valve for a fuel injection system of an internal combustion engine and having a longitudinal valve axis, comprising:

a valve seat element including:

a fixed valve seat, and an enveloping surface equipped with a coating made of a material other than a material of the valve seat element;

a valve seat support that receives and is immovably joined to the valve seat element, wherein:

the coating achieves a hydraulically sealed joining between the valve seat element and the valve seat support, and the hydraulically sealed joining is achieved by the coating without a welding; and a valve closure element that coacts with the fixed valve seat of the valve seat element.

2. The fuel injection valve according to claim 1, wherein:

the coating is applied only in an axial partial region of the enveloping surface.

3. The fuel injection valve according to claim 1, wherein:

the coating includes one of copper, tin, and nickel.

4. The fuel injection valve according to claim 1, wherein:

the coating includes PTFE.

5. The fuel injection valve according to claim 2, wherein:

a circumferential groove arranged on the enveloping surface is filled with the coating.

6. The fuel injection valve according to claim 1, wherein:

the coating is applied over an entire circumference of the enveloping surface in a circumferential direction.

7. A fuel injection valve for a fuel injection system of an internal combustion engine and having a longitudinal valve axis, comprising:

a valve seat element including:

a fixed valve seat, and an enveloping surface equipped with an adhesive;

a valve seat support that receives and is immovably joined to the valve seat element, wherein:

the adhesive achieves a hydraulically sealed joining between the valve seat element and the valve seat support; and a valve closure element that coacts with the fixed valve seat of the valve seat element.

8. The fuel injection valve according to claim 7, wherein:

the adhesive is applied only in an axial partial region of the enveloping surface of the valve seat element.

9. The fuel injection valve according to claim 7, wherein:

the adhesive includes a microencapsulated adhesive, and an encapsulation of the adhesive is ruptured only upon a press-fitting of the valve seat element into the valve seat support.

10. The fuel injection valve according to claim 7, wherein:

the adhesive is applied over an entire circumference of the enveloping surface in a circumferential direction.

11. The fuel injection valve according to claim 7, wherein:

the adhesive is fuel-resistant.

* * * * *